US010414185B2

(12) United States Patent
Luo et al.

(10) Patent No.: US 10,414,185 B2
(45) Date of Patent: Sep. 17, 2019

(54) FULL-WIDTH SEAL DEVICE

(71) Applicant: GRG Banking Equipment Co., Ltd., Guangzhou, Guangdong (CN)

(72) Inventors: Panfeng Luo, Guangdong (CN); Xiaoping Han, Guangdong (CN); Yunlong Wang, Guangdong (CN); Jinjun He, Guangdong (CN); Guocheng Shi, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 633 days.

(21) Appl. No.: 15/030,621

(22) PCT Filed: Oct. 17, 2014

(86) PCT No.: PCT/CN2014/088811

§ 371 (c)(1),
(2) Date: Apr. 20, 2016

(87) PCT Pub. No.: WO2015/070687

PCT Pub. Date: May 21, 2015

(65) Prior Publication Data

US 2016/0279993 A1 Sep. 29, 2016

(30) Foreign Application Priority Data

Nov. 12, 2013 (CN) ..... 2013 1 0561923

(51) Int. Cl.
*B41K 3/04* (2006.01)
*B41K 3/64* (2006.01)
(Continued)

(52) U.S. Cl.
CPC ..... *B41K 3/50* (2013.01); *B31F 1/07* (2013.01); *B41K 3/04* (2013.01); *B41K 3/64* (2013.01); *B44B 5/0052* (2013.01)

(58) Field of Classification Search
CPC .... B41K 3/04; B41K 3/50; B41K 3/64; B44B 5/0019; B44B 5/0052; B31F 1/07
(Continued)

(56) References Cited

U.S. PATENT DOCUMENTS 888,889 A * 5/1908 Gottschalk
5,594,486 A * 1/1997 Kiyohara ..... B41J 11/005 271/274

FOREIGN PATENT DOCUMENTS

CN 2659685 Y 12/2004
CN 1618619 A 5/2005
(Continued)

OTHER PUBLICATIONS

English translation of JP 09-018631 A, publication date Jan. 17, 1997 (Year: 1997).*
(Continued)

*Primary Examiner* — Leslie J Evanisko
(74) *Attorney, Agent, or Firm* — Yue (Robert) Xu; Apex Attorneys at Law, LLP

(57) ABSTRACT

Disclosed is a full-width seal device, the outer part of which comprises a paper inlet, a paper outlet and a housing, and the inner part of which comprises a component moving along the x-axis, a component moving along the y-axis and a seal mechanism, wherein the component moving along the x-axis is used for detecting whether paper has entered the paper inlet and having detected that paper has entered the paper inlet, driving the paper to move along the x-axis; having detected that the paper has moved to a pre-set position on the x-axis, the component moving along the y-axis is used for driving the seal mechanism to move along the y-axis; and after the paper has moved to a pre-set position on the y-axis, the seal mechanism is used for executing a seal operation.

6 Claims, 7 Drawing Sheets

(51) Int. Cl.

| | |
|---|---|
| ***B41K 3/50*** | (2006.01) |
| ***B31F 1/07*** | (2006.01) |
| ***B44B 5/00*** | (2006.01) |

(58) Field of Classification Search
USPC ..... 101/31.1; 400/578, 624, 625, 636, 636.2
See application file for complete search history.

(56) References Cited

FOREIGN PATENT DOCUMENTS

| | | | | |
|---|---|---|---|---|
| CN | 1623796 | A | | 6/2005 |
| CN | 2747058 | Y | | 12/2005 |
| CN | 1899843 | A | | 1/2007 |
| CN | 101037059 | A | | 9/2007 |
| CN | 101474918 | A | | 7/2009 |
| CN | 101875267 | A | | 11/2010 |
| CN | 102815106 | A | | 12/2012 |
| CN | 202847148 | U | | 4/2013 |
| CN | 103552390 | A | | 2/2014 |
| GB | 2076340 | A | | 12/1981 |
| JP | S5995184 | A | | 6/1984 |
| JP | S6027588 | A | | 2/1985 |
| JP | S61106291 | A | | 5/1986 |
| JP | 61181676 | A | * | 8/1986 |
| JP | 09018631 | A | * | 1/1997 |
| JP | H0952421 | A | | 2/1997 |

OTHER PUBLICATIONS

International Search Report for PCT/CN2014/088811, dated Jan. 21, 2015, ISA/CN.
European Search Report for EP 14862649, dated Oct. 20, 2016.

* cited by examiner

FULL-WIDTH SEAL DEVICE

This application is a National Phase entry of PCT Application No. PCT/CN2014/088811, filed Oct. 17, 2014, which claims the benefit of priority to Chinese Patent Application No. 201310561923.X titled "FULL-WIDTH SEAL DEVICE", filed with the Chinese State Intellectual Property Office on Nov. 12, 2013, the entire disclosures of which are incorporated herein by reference.

TECHNICAL FIELD

The present application relates to the field of financial special equipment, and particularly to a full-width seal device for a financial self-service equipment.

BACKGROUND

With the development of the society, financial self-service business is further developed, and transformation of bank branches has become a developing trend of the construction of branches in banking industry, which is become a main access to improve service capacity of branches, image of the industry, service competitiveness and service management capacity. With the expansion of self-service channels, banks are allowed to gradually transfer some low value-added services to the self-service channels, build a variety of bridges for related services, uniform bank resources, perfect the construction of new branches and the expansion of services, and research and develop programs for the expansion of services in the self-service channels, which become one of focal points of future development for financial self-service equipments.

In banking business, a seal as a symbol of corporate rights in China has the functions of confirming legal acts, identifying behavior subject, distinguishing subject identity and representing agent authority, thus, the seal is widely used in various fields in China. In conventional technology, the seal is accomplished by a seal device. However, there is a problem that paper specifications which can be sealed by the current seal device are limited, i.e., a full-width sealing is not be achieved, causing an inconvenient use.

SUMMARY

To address the issues described above, an object of the present application is to provide a full-width seal device. A sealing mechanism of the full-width seal device can achieve the function of a full-width sealing, increase the service efficiency of the seal device and improve the user experience.

The present application provides a full-width seal device:

the full-width seal device includes a paper inlet, a paper outlet and a housing outside, and includes a component movable in an X-axis direction, a component movable in a Y-axis direction and a sealing mechanism inside. The component movable in the X-axis direction is configured to detect whether a piece of paper has entered the paper inlet and move the piece of paper in the X-axis direction if it is detected that the piece of paper has entered the paper inlet. The component movable in the Y-axis direction is configured to move the sealing mechanism in the Y-axis direction after the piece of paper has moved to a pre-set position on the X-axis, and the sealing mechanism is configured to execute a task of sealing after the sealing mechanism has moved to a pre-set position on the Y-axis.

A full-width seal device is provided by the present application. A sealing mechanism of the full-width seal device can achieve the function of a full-width sealing on a piece of paper in the X-axis direction and the Y-axis direction, and an unidirectional imbricate design is adopted for a channel of the full-width seal device and is able to effectively prevent the piece of paper from jamming in the channel, and is able to seal various paper specifications such as A4 and B4, and a hand-screwed detachable design is adopted for a seal replacing mechanism of the full-width seal device, which has an advantage of efficient replacing the seal for maintenance.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

DETAILED DESCRIPTION

The embodiments described hereinafter are only some examples of the present application, and not all implementation. Other embodiments obtained by the person skilled in the art based on the embodiments of the present application without any creative efforts all fall into the protection scope of the present application.

A full-width seal device is provided by the present application. A piece of paper enters a paper inlet of the full-width seal device, which may achieve a full-width sealing on the piece of paper in X-axis and Y-axis directions, and, the piece of paper exits from a paper outlet of the full-width seal device after the sealing is completed. An unidirectional imbricate channel may effectively prevent the piece of paper from jamming in the channel, and is able to seal various paper specifications such as A4 and B4. A seal replacing mechanism of the full-width seal device is hand-screwed detachable, which may quickly replace the seal for maintenance.

Figure 1:
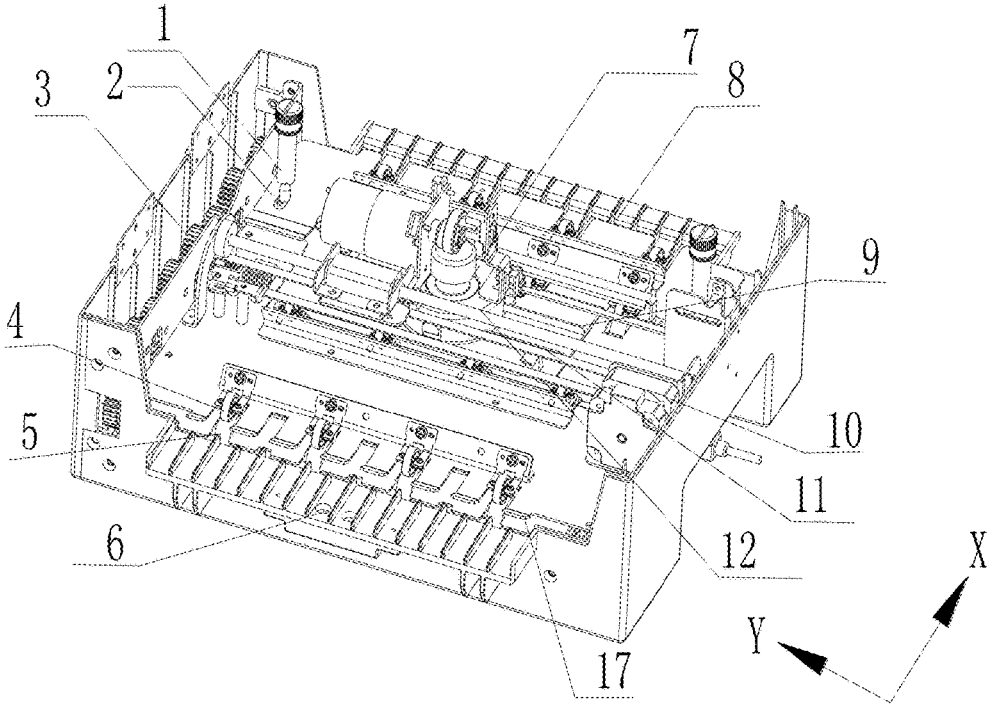
FIG. 1 is a schematic view showing an inner structure of the present application.

FIG. 1 is a schematic view showing an inner structure of the full-width seal device according to an embodiment of the present application. As shown in FIG. 1, the full-width seal device provided by the present application includes a paper inlet, a paper outlet and a housing outside, and includes a component movable in the X-axis direction, a component movable in the Y-axis direction and a sealing mechanism 7 inside. The component movable in the X-axis direction is used for detecting whether a piece of paper has entered the paper inlet and move the piece of paper in the X-axis direction if it is detected that the piece of paper has entered the paper inlet. The component movable in the Y-axis direction is used for moving the sealing mechanism 7 in the Y-axis direction after the piece of paper has moved to a pre-set position on the X-axis. The sealing mechanism 7 is used for executing a task of sealing after the sealing mechanism 7 has moved to a pre-set position on the Y-axis.

Specifically, the component movable in the X-axis direction includes a paper inlet sensor 6, a transmission gear set 3, an upper friction wheel 4, a lower friction wheel 5, the sealing mechanism 7, a second motor 14 and a paper passing channel 17.

The paper inlet sensor 6 is fixed at the paper inlet for detecting whether the piece of paper has entered the paper inlet of the full-width seal device in real time and is connected to the second motor 14. If the piece of paper has entered the paper inlet of the full-width seal device, the second motor 14 is activated. The second motor 14 is fixed at the bottom of the housing and connected to the transmission gear set 3. The transmission gear set 3 is fixed on the housing, is located in the X-axis direction (the X-axis direction and the Y-axis direction are as shown in FIG. 1) and is connected to the upper friction wheel 4 and the lower friction wheel 5. The transmission gear set 3 is rotated by the second motor 14 when the second motor 14 is activated. The upper friction wheel 4 and the lower friction wheel 5 are further rotated as the transmission gear set 3 is rotated. The upper friction wheel 4 is located above the paper passing channel 17, and the lower friction wheel 5 is located below the paper passing channel 17, and the upper friction wheel 4 moves in an opposite direction to the lower friction wheel 5, such that a friction driving force is applied to the piece of paper, and the piece of paper is moved in the X-axis direction freely by the friction driving force. The paper passing channel 17 is used as a channel in which the piece of paper can be moved in the X-axis direction, and the channel extends to the paper outlet from the paper inlet through the full-width seal device. The piece of paper enters the paper passing channel 17 form the paper inlet, and, is moved to the paper outlet through the paper passing channel 17 after the sealing is completed.

Figure 2:
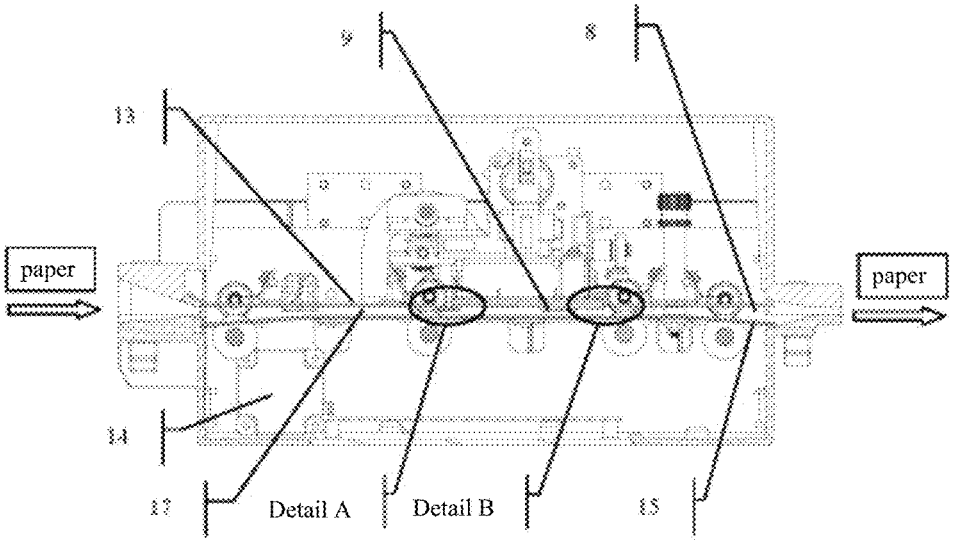
FIG. 2 is a sectional view of a paper passing channel with an unidirectional imbricate design of the present application.
Figure 3:
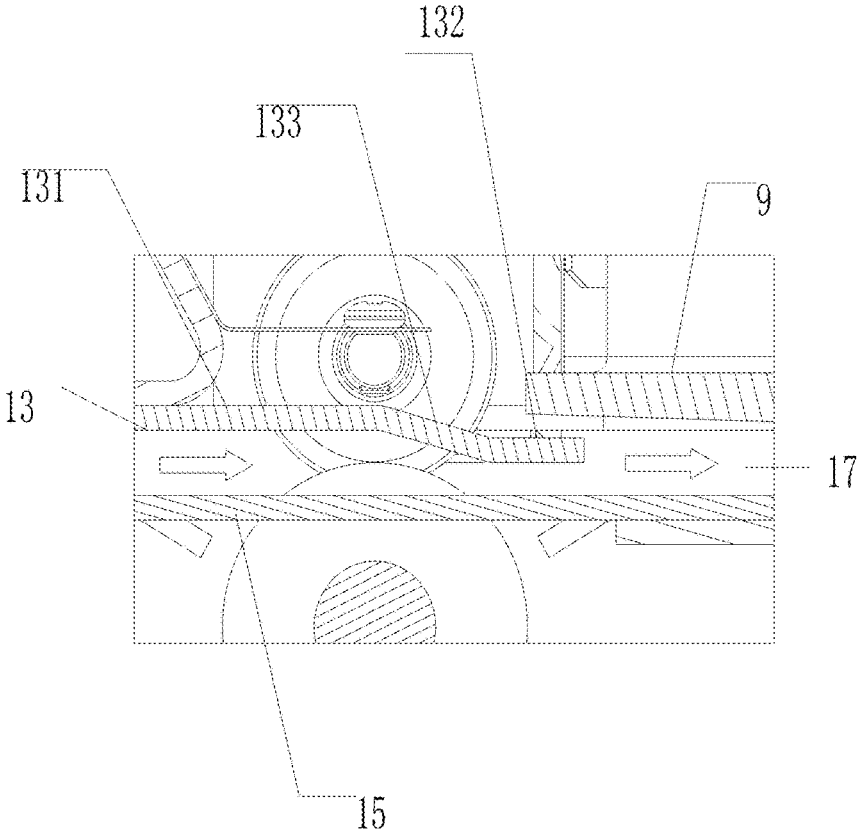
FIG. 3 is an enlarged schematic view of a detail A in FIG. 2.
Figure 4:
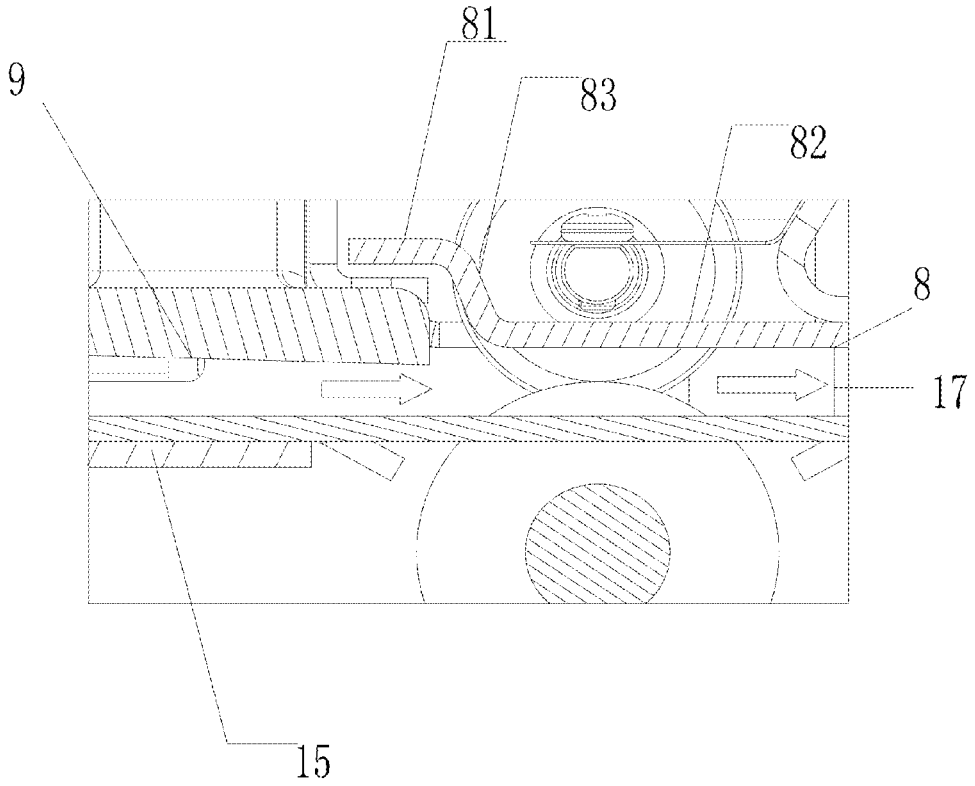
FIG. 4 is an enlarged schematic view of a detail B in FIG. 2.

FIG. 2 is a section view of an unidirectional imbricate paper passing channel. As shown in FIG. 2, the full-width seal device includes multiple sets of upper friction wheels 4 and multiple sets of lower friction wheels 5. Each set of upper friction wheels 4 includes four upper friction wheels 4, and each set of lower friction wheels 5 includes four lower friction wheels 5. The upper friction wheels 4 and the lower friction wheels 5 are both arranged in the X-axis direction at a certain interval, and are paralleled in pairs in an vertical direction. The paper passing channel 17 includes a lower channel plate 15, a front channel upper plate 13, a sealing mechanism guide plate 9 and a seal bracket press plate 8. The lower channel plate 15 forms a lower surface of the whole paper passing channel 17, which is made of a whole piece of sheet metal part and extends to the paper outlet from the paper inlet, The lower channel plate 15 is drilled with multiple sets of small holes with each set having four small holes, and the small holes are located corresponding to the lower friction wheels respectively, such that the lower friction wheels 5 pass the small holes in the lower channel plate respectively to partly pass through the lower channel plate 15. The front channel upper plate 13, the sealing mechanism guide plate 9 and the seal bracket press plate 8 together form an upper surface of the whole paper passing channel 17. Specifically, the front channel upper plate 13 is drilled with multiple sets of small holes with each set having two small holes, and the small holes are located corresponding to the two upper friction wheels 4 adjacent to the paper inlet respectively, such that the two upper friction wheels 4 pass the two small holes in the front channel upper plate to partly pass through the front channel upper plate 13. The sealing mechanism guide plate is overlapped on the front channel upper plate, and the seal bracket press plate is overlapped on the seal bracket guide plate. The sealing mechanism guide plate and the seal bracket press plate both act as the channel to guide paper and ensure a smooth pass of the piece of paper. FIG. 3 is an enlarged schematic view of a detail A in FIG. 2. As shown in FIG. 3, the front channel upper plate 13 is bent to form a first horizontal surface 131, second horizontal surface 132, and a first inclined surface 133 connecting the first horizontal surface 131 and the second horizontal surface 132, in which the second horizontal surface 132 is lower than the first horizontal surface 131, and each of angels formed by the first inclined surface 133 and the first horizontal surface 131 and by the first inclined surface 133 and the second horizontal surface 132 is an obtuse angle. The function of this design is to provide a connection and guide between two discontinuous transmission channels, so as to prevent an front end of the piece of paper from tilting and further cause a jam. The sealing mechanism guide plate 9 is overlapped on the second horizontal surface 132 of the front channel upper plate 13 for fixing the sealing mechanism 6. The seal bracket press plate 8 is drilled with multiple sets of small holes with each set having two small holes, and the small holes are located corresponding to the two upper friction wheels 4 adjacent to the paper outlet respectively, such that the two upper friction wheels 4 pass into the corresponding small holes to partly pass through the seal bracket press plate 8. FIG. 4 is an enlarged schematic view of a detail B in FIG. 2. As shown in FIG. 4, the seal bracket press plate 8 is bent to form a third horizontal surface 81, a fourth horizontal surface 82 and a second inclined surface 83 connecting the third horizontal surface 81 and the fourth horizontal surface 82, in which the third horizontal surface 81 is higher than the fourth horizontal surface 82, and each of angels formed by the second inclined surface 83 and the third horizontal surface 81 and by the second inclined surface 83 and the fourth horizontal surface 82 is an obtuse angle, and the third horizontal surface 81 is overlapped on the sealing mechanism guide plate 9 The function of this design is also to ensure a smooth paper pass. The design of the paper passing channel described above is also referred to as an unidirectional imbricate design, which ensures a smooth paper pass, which thus prevents a paper jam.

The component movable in the Y-axis direction includes a first motor 10 and a belt 11. The first motor 10 is connected to one end of the belt 11, and the sealing mechanism 7 is connected to the other end of the belt 11. The first motor 10, the belt 11 and the sealing mechanism 7 are all located in the Y-axis direction. When the piece of paper reaches the pre-set position on the X-axis, the first motor 10 is activated and the belt 11 is rotated, and the sealing mechanism 7 is further moved in the Y-axis direction as the belt 11 is rotated. The seal mechanism 7 executes a task of sealing after the seal mechanism 7 has moved to the pre-set position on the Y-axis.

Figure 5:
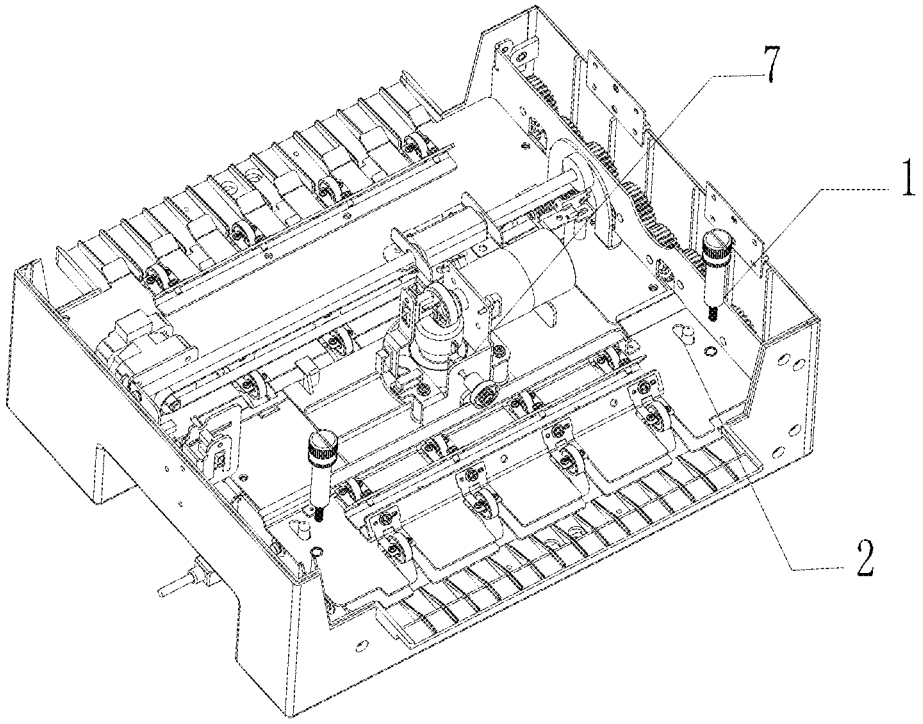
FIG. 5 is a schematic view of a seal replacing mechanism in which hand-screwed screws are screwed off.
Figure 6:
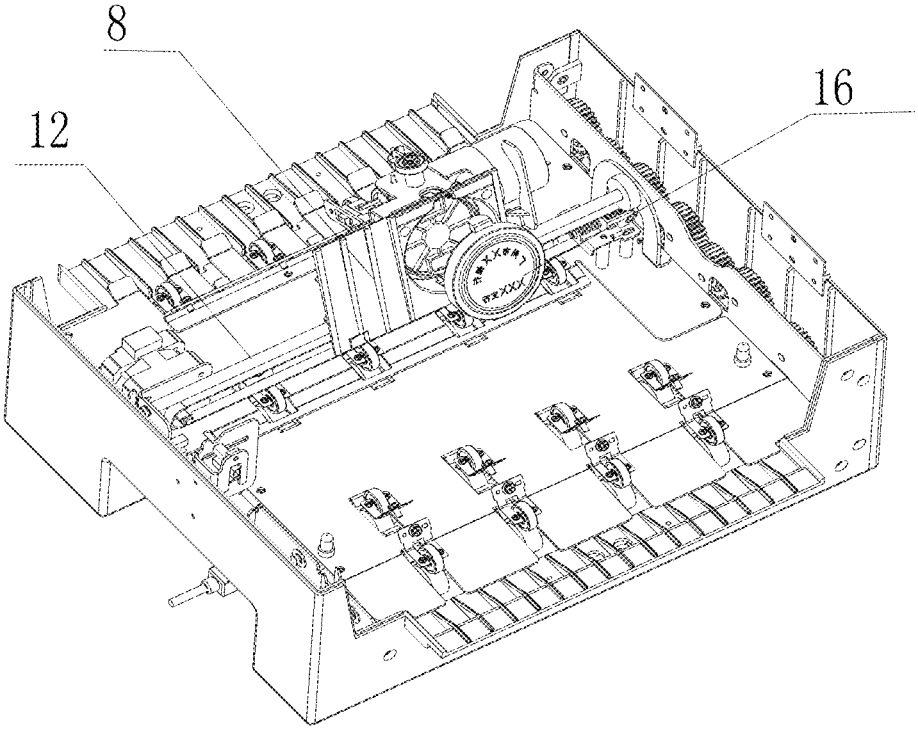
FIG. 6 is a schematic view of the seal replacing mechanism in which a seal is being replaced.

FIG. 5 is a schematic view of a seal replacing mechanism of the present application, in which hand-screwed screws are screwed off. As shown in FIG. 5, the full-width seal device further includes a hand-screwed screw 1 and a seal assembly press plate guiding column 2. The hand-screwed screws 1 and the seal assembly press plate guiding column 2 are both fixed to the seal bracket press plate 8. The seal bracket press plate 8 can be detached through screwing off the hand-screwed screw 1 by hand, and the seal assembly press plate guiding column 2 is used for mounting the seal bracket press plate at a pre-set position correctly, and once a piece of paper is jammed in the channel by accident, the seal assembly pressing plate can be opened easily, and with the help of the seal assembly press plate guiding column, the detached and opened channel can be mounted and positioned quickly, thus a convenient detachment can be achieved. FIG. 6 is a schematic view showing the seal being replaced. As shown in FIG. 6, the sealing mechanism 7 includes a sealing mechanism spindle 12 and a seal 16 connected to each other. When being replaced, the seal 16 is overturned around the sealing mechanism spindle 12, which acts as a center of rotation, to be replaced with a new seal, then the seal replacing is completed. Compared with the conventional technology, the seal replacing above is more convenient and efficient.

Figure 7A:
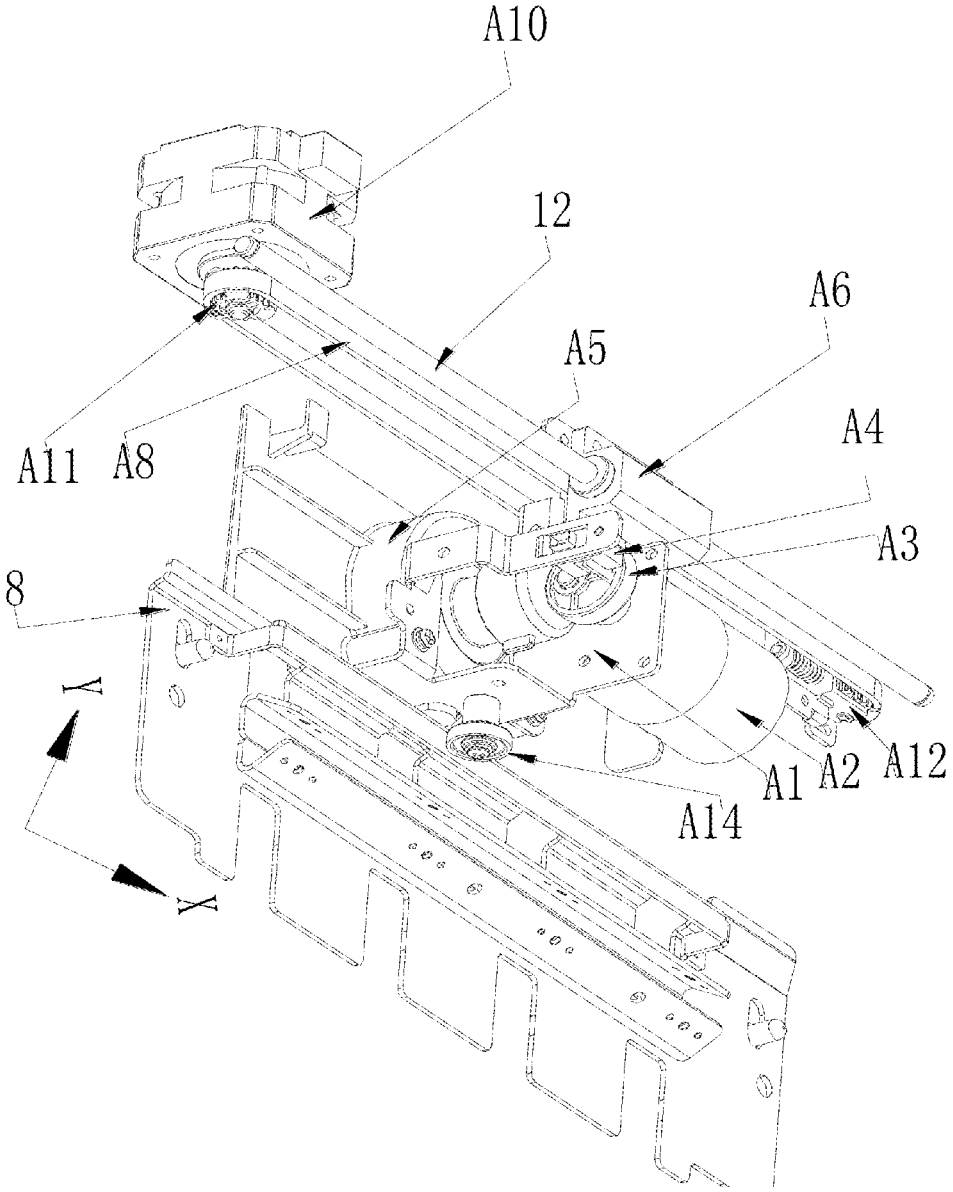
FIG. 7*a* is a front schematic view showing the structure of the seal replacing mechanism of the present application.
Figure 7B:
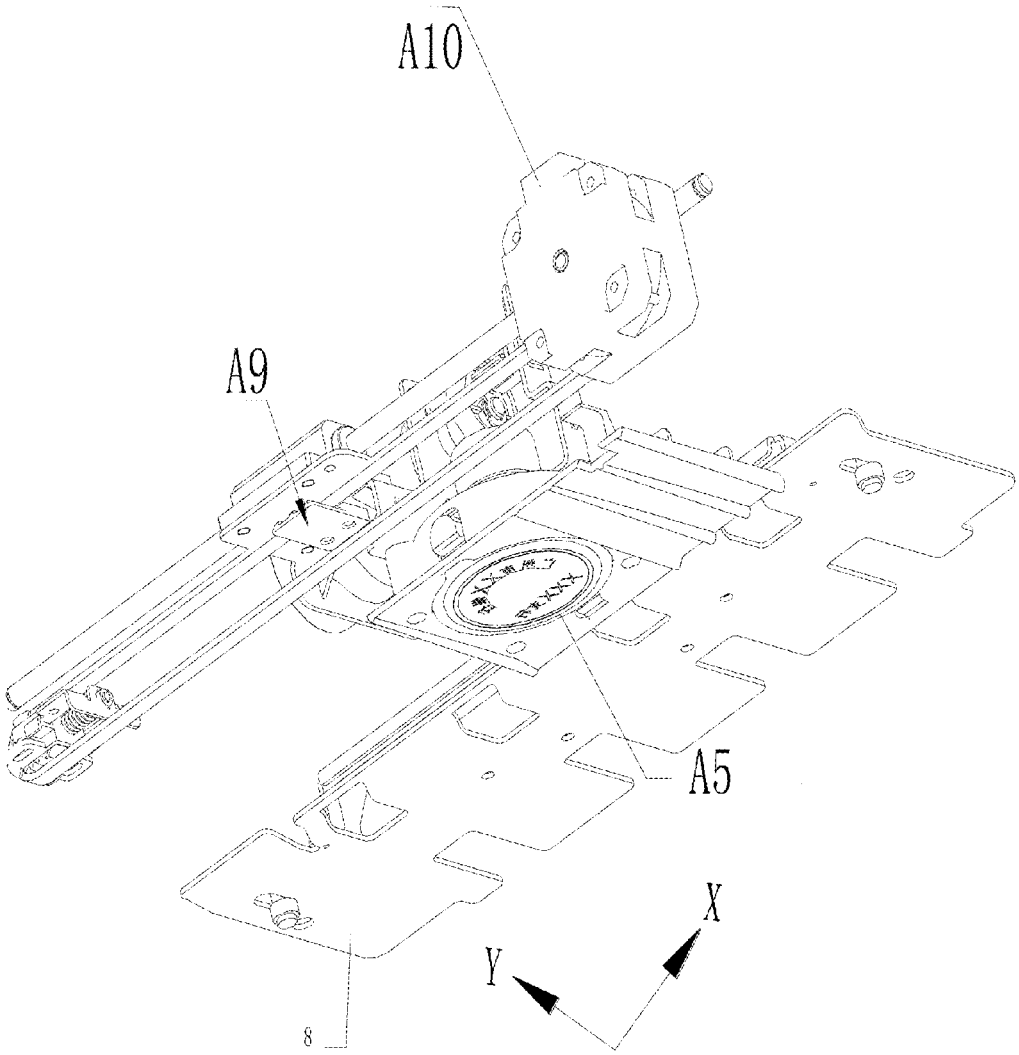
FIG. 7*b* is a back schematic view showing the structure of the seal replacing mechanism of the present application.

It is noted that the sealing mechanism is as shown in FIGS. 7*a* and 7*b*. FIG. 7*a* is a front schematic view. FIG. 7*b* is a back schematic view. The sealing mechanism includes a sealing mechanism bracket A1, a direct current motor A2, a cam A3, a U-shaped sensor A4, a seal assembly A5, a linear bearing assembly A6, the sealing mechanism spindle 12, a synchronous belt A8, a synchronous belt clamping block A9, a synchronous motor A10, a synchronous pulley fixing bracket assembly A11, synchronous pulleys (two) A12, the seal bracket press plate 8 and a guide wheel 14. The seal assembly A5, the linear bearing assembly A6, the synchronous belt clamping block A9 and the guide wheel 14 are fixed to the sealing mechanism bracket A1. The sealing mechanism spindle 12 passes through the linear bearing assembly A6 to provide guidance to the sealing mechanism in the Y-axis direction. The sealing mechanism is supported by the guide wheel 14, and the guide wheel 14 presses on the seal bracket press plate 8. The synchronous belt A8 is clamped into the synchronous belt clamping block. The seal assembly is moved in the Y-axis direction freely as the synchronous belt is moved by being pulled by the synchronous motor A10 via the synchronous pulleys A12. The synchronous pulley fixing bracket assembly A11 is used for fixing the synchronous pulleys. The sealing mechanism bracket is below the seal bracket press plate, and when the task of sealing is not executed, the sealing mechanism bracket is spaced from the seal bracket press plate by 2 mm, thus when the seal assembly is moved in the Y-axis direction, there is no frictional resistance between the sealing mechanism bracket and the seal bracket press plate. When the seal assembly executes the task of sealing, the cam is rotated by the direct current motor A2, and the cam will then apply a depressing force to the seal assembly, and when the seal assembly contacts the piece of paper and executes the task of sealing, the piece of paper and the seal are supported by the lower channel plate, and the sealing mechanism bracket will be moved upwards and a depressing force will be applied to the sealing mechanism bracket by the seal bracket press plate to make a seal on the piece of paper to be clear. When the cam is rotated by the direct current motor A2 for one turn and stop at a position corresponding to the U-shaped sensor A4, the task of sealing is completed.

The invention claimed is:

1. A full-width seal device, comprising a paper inlet, a paper outlet and a housing outside, wherein the full-width seal device comprises a component configured to provide movement to a piece of paper in an X-axis direction, a component movable in a Y-axis direction and a sealing mechanism inside, wherein the component configured to provide movement to the piece of paper in the X-axis direction is configured to detect whether the piece of paper has entered the paper inlet and move the piece of paper in the X-axis direction after the piece of paper has entered the paper inlet, and the component movable in the Y-axis direction is configured to move the sealing mechanism in the Y-axis direction after the piece of paper has moved to a pre-set position on the X-axis, and the sealing mechanism is configured to execute a task of sealing after the sealing mechanism has moved to a pre-set position on the Y-axis, wherein the component configured to provide movement to the piece of paper in the X-axis direction comprises a paper inlet sensor, a transmission gear set, an upper friction wheel, a lower friction wheel, a second motor and a paper passing channel, wherein the paper inlet sensor is fixed at the paper inlet and is connected to the second motor for detecting whether the piece of paper has entered the paper inlet in real time, and if the piece of paper has entered the paper inlet of the device, the second motor is activated, and the second motor is connected to the transmission gear set, and the transmission gear set is fixed to the housing, is located in the X-axis direction and is connected to the upper friction wheel and the lower friction wheel, and the transmission gear set is rotated by the second motor when the second motor is activated, and the upper friction wheel and the lower friction wheel are further rotated as the transmission gear set is rotated, the upper friction wheel moves in an opposite direction to the lower friction wheel for providing a friction driving force to the piece of paper, and the friction driving force allows the piece of paper to move in the X-axis direction, and the paper passing channel connects the paper inlet and the paper outlet, and the piece of paper enters the paper passing channel from the paper inlet, and after the sealing is completed, the piece of paper is moved to the paper outlet through the paper passing channel, wherein the paper passing channel comprises a lower channel plate, a front channel upper plate, a sealing mechanism guide plate and a seal bracket press plate, wherein the lower channel plate is made of a whole piece of sheet metal part and extends to the paper outlet from the paper inlet and is drilled with a plurality of sets of small holes, and the small holes in the lower channel plate are located corresponding to the lower friction wheel respectively, and the lower friction wheel pass the small holes in the lower channel plate to partly pass through the lower channel plate, and the front channel upper plate is drilled with a plurality of sets of small holes with each set having two small holes, and the small holes are located corresponding to the upper friction wheel adjacent to the paper inlet respectively, and the upper friction wheel pass the small holes in the front channel upper plate to partly pass through the front channel upper plate, and the sealing mechanism guide plate is overlapped on the front channel upper plate, and the seal bracket press plate is overlapped on the seal bracket guide plate.

2. The full-width seal device according to claim 1, wherein the front channel upper plate is bent to form a first horizontal surface, a second horizontal surface and a first inclined surface connecting the first horizontal surface and the second horizontal surface, and the second horizontal surface is lower than the first horizontal surface, and the sealing mechanism guide plate is overlapped on the second horizontal surface of the front channel upper plate for fixing the sealing mechanism, and the seal bracket press plate is bent to form a third horizontal surface, a fourth horizontal surface and a second inclined surface connecting the third horizontal surface and the fourth horizontal surface, and the third horizontal surface is higher than the fourth horizontal surface, and the third horizontal surface is overlapped on the sealing mechanism guide plate.

3. The full-width seal device according to claim 1, wherein the component movable in the Y-axis direction comprises a first motor and a belt, and the first motor is connected to the belt, and the belt is connected to the sealing mechanism, and, the first motor, the belt and the sealing mechanism are all located in the Y-axis direction, and when the piece of paper reaches the pre-set position on the X-axis, the first motor is activated and the belt is rotated, and the sealing mechanism is further moved in the Y-axis direction as the belt is rotated.

4. The full-width seal device according to claim 1, wherein the device further comprises a hand-screwed screw and a seal assembly press plate guiding column, and the hand-screwed screw and the seal assembly press plate guiding column are both fixed on the seal bracket press plate, and the hand-screwed screw is configured to fix the seal bracket press plate, and the seal assembly press plate guiding column is configured to mount the seal bracket press plate at a pre-set position correctly.

5. The full-width seal device according to claim 4, wherein the sealing mechanism comprises a sealing mechanism spindle and a seal connected to each other, and when the seal is replaced, the seal bracket press plate is detached by screwing off the hand-screwed screws, and the seal is overturned around the sealing mechanism spindle, which acts as a center of rotation, to be replaced by a new seal, and the task of seal replacing is completed.

6. The full-width seal device according to claim 5, wherein the sealing mechanism comprises a sealing mechanism bracket, a direct current motor, a cam, a U-shaped sensor, a seal assembly, a linear bearing assembly, the sealing mechanism spindle, a synchronous belt, a synchronous belt clamping block, a synchronous motor, a synchronous pulley fixing bracket assembly, a synchronous pulley, the seal bracket press plate and a guide wheel, wherein the seal assembly, the linear bearing assembly, the synchronous belt clamping block and the guide wheel are fixed to the sealing mechanism bracket, and the sealing mechanism spindle passes through the linear bearing assembly to provide guidance to the sealing mechanism in the Y-axis direction, and the guide wheel presses on the seal bracket press plate, and the synchronous belt is clamped into the synchronous belt clamping block, the synchronous pulley is fixed to the synchronous pulley fixing bracket assembly, and the cam is connected to the direct current motor, and when the task of sealing is executed, the cam is rotated by the direct current motor, and the cam applies a depressing force to the seal assembly to execute the task of sealing.

* * * * *